US012390030B2

(12) United States Patent
Edwards et al.

(10) Patent No.: US 12,390,030 B2
(45) Date of Patent: Aug. 19, 2025

(54) PILLOW WITH CYLINDRICAL INSERTS

(71) Applicants: Channé Edwards, Beverly Hills, CA (US); Cayla Presley, Beverly Hills, CA (US)

(72) Inventors: Channé Edwards, Beverly Hills, CA (US); Cayla Presley, Beverly Hills, CA (US)

( * ) Notice: Subject to any disclaimer, the term of this patent is extended or adjusted under 35 U.S.C. 154(b) by 361 days.

(21) Appl. No.: 18/051,641

(22) Filed: Nov. 1, 2022

(65) Prior Publication Data

US 2023/0135899 A1 May 4, 2023

Related U.S. Application Data

(60) Provisional application No. 63/263,400, filed on Nov. 2, 2021.

(51) Int. Cl.
*A47G 9/10* (2006.01)
*A47G 9/02* (2006.01)

(52) U.S. Cl.
CPC ..... *A47G 9/10* (2013.01); *A47G 9/0253* (2013.01); *A47G 2009/1018* (2013.01); *A47G 9/1036* (2013.01)

(58) Field of Classification Search
CPC .. A47G 9/10; A47G 2009/1018; A47C 7/383; A47C 20/02; A47C 20/025
See application file for complete search history.

(56) References Cited

U.S. PATENT DOCUMENTS

| | | | | |
|---|---|---|---|---|
| 243,228 | A * | 6/1881 | Doremus | A47G 9/10 428/6 |
| 2,877,472 | A * | 3/1959 | Wagner | A47G 9/10 5/636 |
| 5,572,757 | A * | 11/1996 | O'Sullivan | A47C 7/46 5/636 |
| 5,732,426 | A | 3/1998 | Furuya et al. | |
| 5,940,913 | A | 8/1999 | Horowitz | |
| 5,987,676 | A | 11/1999 | Littleford et al. | |
| 6,151,733 | A | 11/2000 | Takashima | |
| 6,170,103 | B1 | 1/2001 | Wang et al. | |
| 6,442,778 | B1 * | 9/2002 | Shaharbani | A47G 9/10 5/636 |
| 6,795,990 | B1 | 9/2004 | Hutchinson | |
| 7,120,953 | B2 | 10/2006 | Ferber et al. | |
| 7,222,379 | B2 | 5/2007 | DiGirolamo | |
| 7,874,032 | B2 | 1/2011 | North et al. | |
| 7,904,977 | B1 * | 3/2011 | Singh | A47G 9/0246 5/497 |

(Continued)

FOREIGN PATENT DOCUMENTS

| | | | |
|---|---|---|---|
| CN | 204970611 U | * | 1/2016 |
| CN | 108851855 A | * | 11/2018 |

(Continued)

*Primary Examiner* — Eric J Kurilla
(74) *Attorney, Agent, or Firm* — Dunlap Bennett & Ludwig, PLLC

(57) ABSTRACT

A pillow with a plurality of cylinders snugly fit in a liner and the liner enclosed in a pillowcase wherein the cylinders are rotatable and interchangeable. The plurality of cylinders may be stacked or grouped to form a triangular formation when viewed from a side. The each of the plurality of cylinders may be selectively rotated while within the pillow for cooling purposes.

14 Claims, 2 Drawing Sheets

(56) References Cited

U.S. PATENT DOCUMENTS

| | | | | |
|---|---|---|---|---|
| D655,964 | S * | 3/2012 | Dror | D6/601 |
| 9,101,235 | B2 | 8/2015 | Yu | |
| 9,247,836 | B2 | 2/2016 | DuPre | |
| 10,123,638 | B2 | 11/2018 | Thorn | |
| 10,827,843 | B2 | 11/2020 | Miller | |
| 11,064,826 | B2 | 7/2021 | Son et al. | |
| 11,109,698 | B1 | 9/2021 | Ogden | |
| 11,141,009 | B1 * | 10/2021 | Rane | A47G 9/10 |
| 11,446,197 | B2 | 9/2022 | Cortese | |
| 2005/0210590 | A1 * | 9/2005 | DiGirolamo | A47G 9/10 5/636 |
| 2006/0179573 | A1 * | 8/2006 | Nissen | A47G 9/1027 128/845 |
| 2007/0113347 | A1 * | 5/2007 | Lindell | A47G 9/10 5/636 |
| 2007/0226909 | A1 * | 10/2007 | Goldman | A47G 9/10 5/636 |
| 2009/0056024 | A1 * | 3/2009 | Paranjpe | A47C 27/146 5/643 |
| 2014/0283303 | A1 * | 9/2014 | Rochlin | A47G 9/10 5/636 |
| 2017/0055737 | A1 * | 3/2017 | Rochlin | A47G 9/10 |
| 2020/0154912 | A1 * | 5/2020 | Del Balso | A47G 9/10 |
| 2022/0079360 | A1 | 3/2022 | Broadbelt | |
| 2022/0304411 | A1 | 9/2022 | Maddock et al. | |
| 2022/0312977 | A1 | 10/2022 | Riday | |
| 2022/0322852 | A1 | 10/2022 | Sramek | |
| 2022/0395117 | A1 * | 12/2022 | Bair | A47C 31/11 |

FOREIGN PATENT DOCUMENTS

| | | | | |
|---|---|---|---|---|
| DE | 202010016133 U1 * | 4/2011 | | A47C 31/006 |
| KR | 20220169479 A * | 12/2022 | | |

* cited by examiner

PILLOW WITH CYLINDRICAL INSERTS

CROSS-REFERENCE TO RELATED APPLICATION

This application claims the benefit of priority of U.S. provisional application No. 63/263,400, filed Nov. 2, 2021, the contents of which are herein incorporated by reference.

BACKGROUND OF THE INVENTION

The present invention relates to pillows and, more particularly, to a pillow with cylindrical inserts.

Standard pillows are limited in comfort. Traditional materials used to fill pillows, such as feathers, become flat and lose their fluff and shape over time. The standard shape of a pillow does not meet the needs of many users.

As can be seen, there is a need for a pillow that does not lose its shape or its fluff with age and provides adequate support for all users.

SUMMARY OF THE INVENTION

In one aspect of the present invention, a pillow comprises a plurality of cylinders snugly fit in a liner and the liner enclosed in a pillowcase wherein the cylinders are rotatable and interchangeable.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

A general overview of the various features of the invention will be provided, with a detailed description following. Broadly, an embodiment of the present invention provides a pillow comprising three cylinders, a lining, and a pillowcase. The cylinders may be foam.

The cylinders may be stacked or grouped to form a triangular formation when viewed from a side. The foam cylinders may have a density of approximately 2.25-2.5 lbs. per cubic inch with an approximate 1.00 pound per linear inch tear strength. A radius of the foam cylinders may range from 1.5 to 3 inches. A length of the foam cylinders may be approximately 18 inches. The radius and length of the foam cylinders are not particularly limited by the present invention and any length or radius may be used. The cylinders may be interchangeable, enabling a user to remove cylinders and replace them or customize the pillow with a predetermined amount of cylinders of various sizes. The cylinders may also be rotatable while within the pillow for cooling purposes.

The cylinders are housed in a lining. The lining may be mesh and may be breathable. The lining holds the foam cylinders in place, cools the cylinders, and prevents moisture from accumulating on the cylinders. The lining may be a triangular prism with round edges. The lining may have a zipper, buttons, or another mechanism for sealing the lining on an end. The lining may have a height of 5 inches and a length of 18 inches. The height and length of the lining are not particularly limited by the present invention and any height or length large enough to house or snuggly fit the cylinders may be used. The liner may be a continuous piece of fabric forming with a triangular cross section. In some embodiments, when removed from the pillowcase and cylinders, the liner forms a cylinder. The liner may lack sidewalls for an additional cooling effect.

A pillowcase surrounds the lining. The pillowcase may be a size slightly larger than the lining to encompass it. The pillowcase may have a zipper, buttons, or another mechanism for sealing the pillowcase on an end.

The cylinders may rotate within the bounds of the pillowcase and interior liner to facilitate a cooling effect for a user.

In some embodiments, three cylinders are utilized. The cylinders may vary in size. For example, two large cylinders may be utilized with one smaller cylinder. However, a plurality of smaller cylinders may be used. Any combination of sizes may be utilized.

Figure 1:
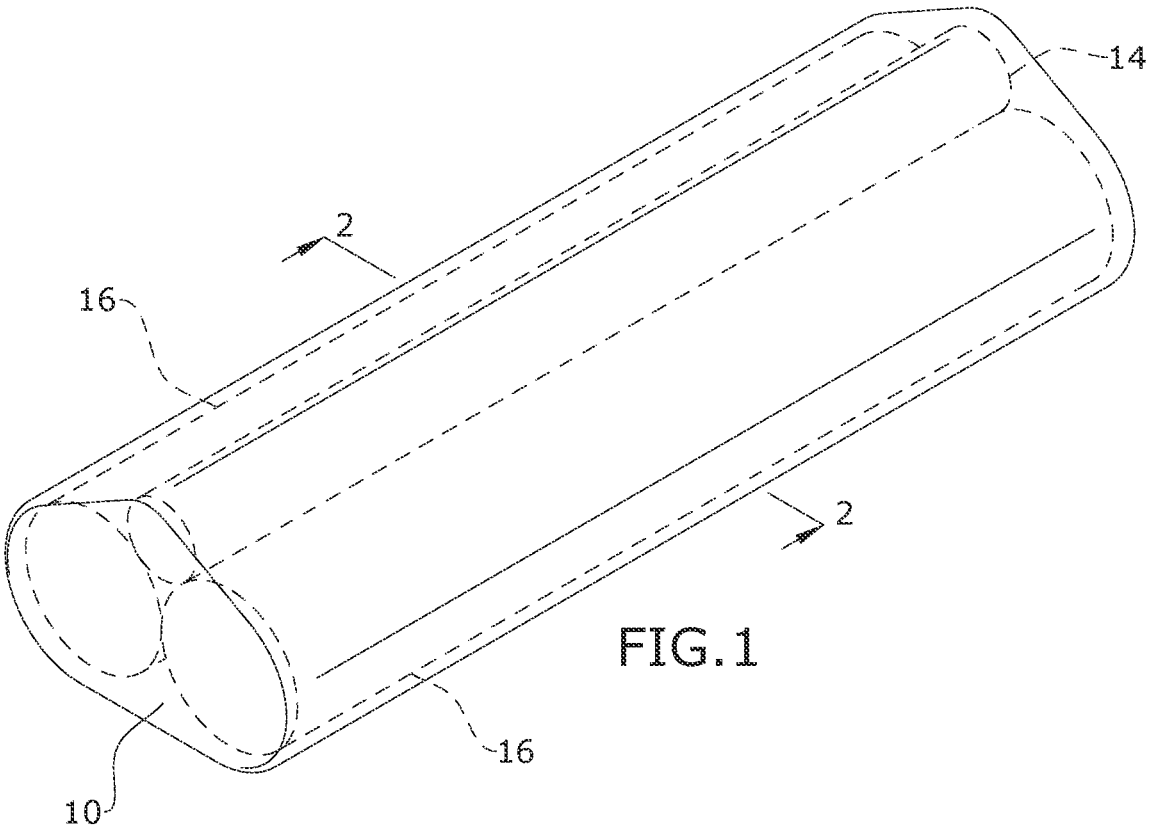
FIG. 1 is a top front perspective view of a pillow according to an embodiment of the present invention.
Figure 2:
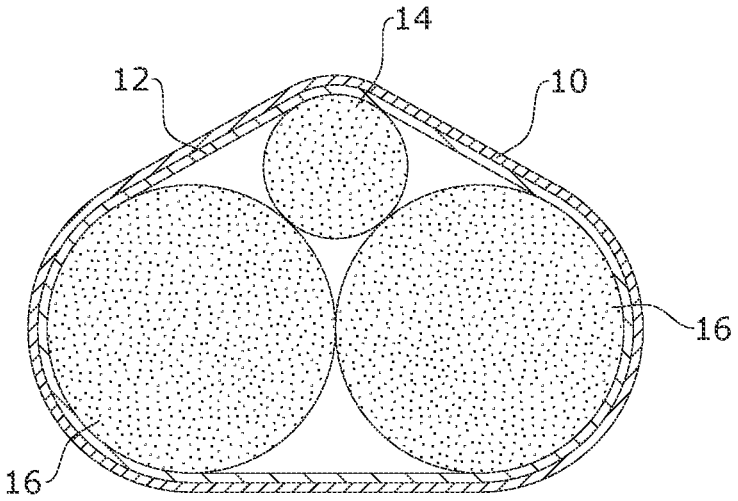
FIG. 2 is a cross sectional view taken on line 2-2 of FIG. 1.
Figure 3:
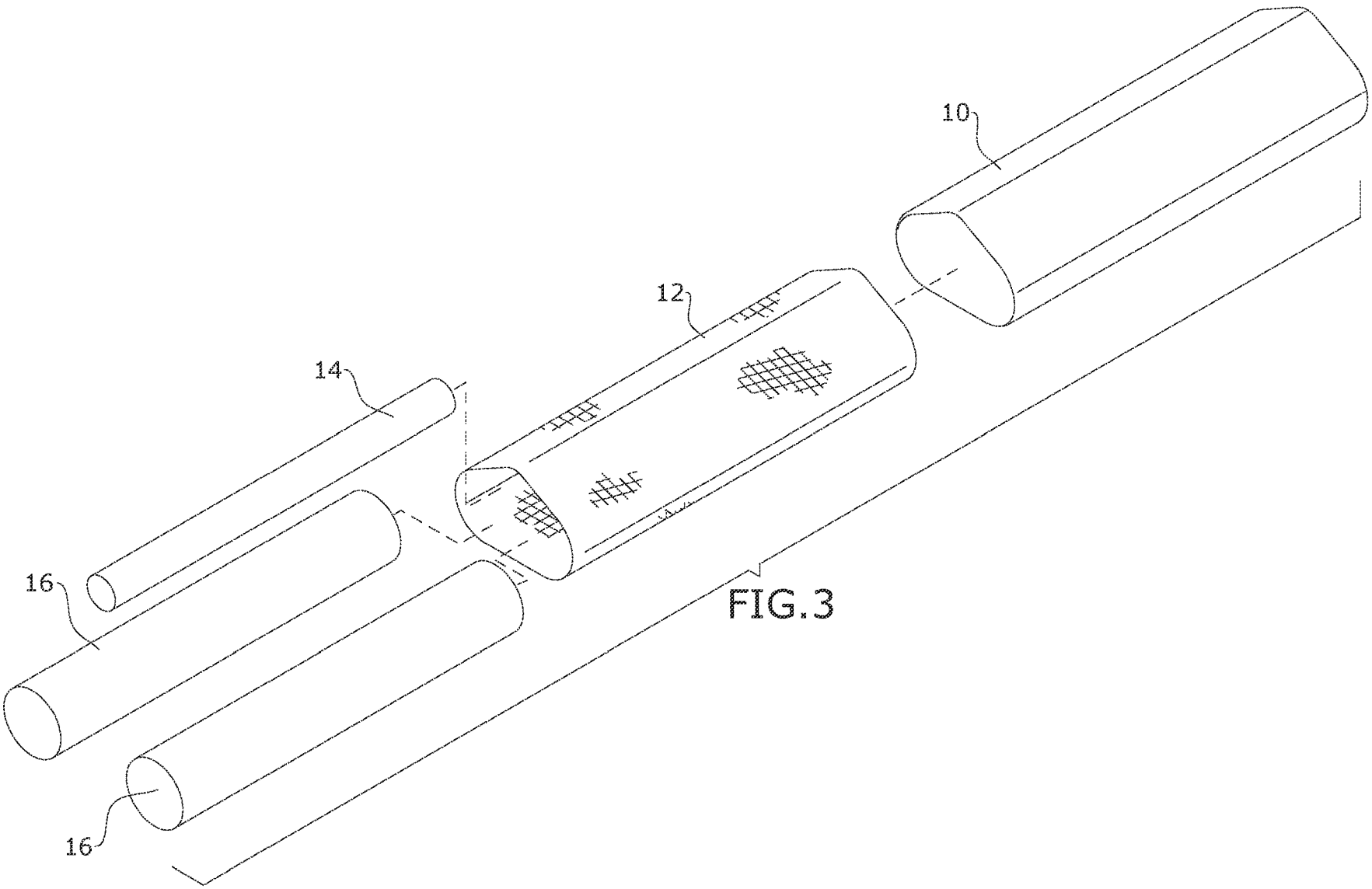
FIG. 3 is an exploded view thereof.

Referring now to FIGS. 1-3, a pillowcase 10 encloses a mesh liner 12. Inside the mesh liner 12 are two large foam cylinders 16 and a small foam cylinder 14. The two large foam cylinders 16 and the small foam cylinder 14 are stacked to form a triangle. The mesh liner 12 constrains the cylinders 14, 16 and maintains the triangular shape.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "snugly" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A pillow comprising:

a liner enclosed in a pillowcase; and the liner defines a triangular prism with rounded edges, wherein the liner is dimensioned and shaped to removably and snugly house a plurality of cylinders are rotatable relative to each other when so housed;

wherein the plurality of cylinders comprises foam cylinders; and wherein the plurality of cylinders comprise two adjacent first cylinders and one second cylinder, wherein the second cylinder has a diameter less than the two first cylinders, and wherein the second cylinder is nestled in a space between the two adjacent first cylinders to define a triangular cross section, wherein said three cylinders are snugly constrained by the triangular prism of the liner to hold the triangular cross section while enabling said three cylinders to rotate relative to each other so that a user of the pillow is enabled to selectively facilitate a cooling effect by rotating each cylinder.

2. The pillow of claim 1, wherein the liner is a mesh liner.

3. The pillow of claim 1, wherein each of the two first cylinders has a radius of approximately 3 inches and the one second cylinder has a radius of approximately 1.5 inches.

4. The pillow of claim 3, wherein each of the plurality of the cylinders has a length of approximately 18 inches.

5. The pillow of claim 4, wherein said foam has a density of approximately 2.25-2.5 lbs. per cubic inch with an approximate 1.00 pound per linear inch tear strength.

6. The pillow of claim 1, wherein the pillowcase defines a triangular prism with rounded edges, wherein the pillowcase is dimensioned and shaped to removably receive the liner.

7. A pillow comprising:

a pillowcase; and a liner dimensioned and shaped to move between an unenclosed condition and an enclosed condition relative to the pillowcase, wherein in the unenclosed condition the liner defines a triangular prism, wherein the liner is dimensioned and shaped to removably house a plurality of cylinders that are rotatable relative to each other when so housed;

wherein the plurality of cylinders is snugly housed in the liner, and wherein the plurality of cylinders comprises two adjacent first cylinders and one second cylinder nestled in a space between the two adjacent first cylinders to define a triangular cross section;

wherein said three cylinders are rotatable relative to each other so that a user of the pillow is enabled to selectively facilitate a cooling effect by rotating each cylinder.

8. The pillow of claim 7, wherein the triangular prism has rounded edges in the unenclosed condition.

9. The pillow of claim 2, wherein said three cylinders are foam cylinders.

10. The pillow of claim 9, wherein the liner is a mesh liner.

11. The pillow of claim 10, wherein each of the two first cylinders has a radius of approximately 3 inches and the one second cylinder has a radius of approximately 1.5 inches.

12. The pillow of claim 11, wherein each of the plurality of the cylinders has a length of approximately 18 inches.

13. The pillow of claim 12, wherein said foam has a density of approximately 2.25-2.5 lbs. per cubic inch with an approximate 1.00 pound per linear inch tear strength.

14. The pillow of claim 7, wherein the pillowcase defines a triangular prism with rounded edges.

* * * * *